US006918532B2

(12) United States Patent
Sierra-Gomez et al.

(10) Patent No.: US 6,918,532 B2
(45) Date of Patent: Jul. 19, 2005

(54) RESEALABLE FOOD CONTAINER

(75) Inventors: Gladys Odette Sierra-Gomez, Woodbridge, NJ (US); Eva Marie Peters, Cedar Grove, NJ (US); Joseph Stiener, Warren, NJ (US); Charles Francis Flynn, IV, Oak Ridge, NJ (US); James Spencer Mandle, Woodcliff Lake, NJ (US)

(73) Assignee: Kraft Foods Holdings, Inc., Northfield, IL (US)

( * ) Notice: Subject to any disclaimer, the term of this patent is extended or adjusted under 35 U.S.C. 154(b) by 119 days.

(21) Appl. No.: 10/414,502

(22) Filed: Apr. 16, 2003

(65) Prior Publication Data

US 2004/0206637 A1 Oct. 21, 2004

(51) Int. Cl.[7] ..... B65D 65/26; B65D 75/28; B65D 85/00; B65D 25/10

(52) U.S. Cl. ..... 229/87.08; 206/459.1; 229/87.05; 383/203; 383/205; 426/119

(58) Field of Search ..... 206/459.1, 807; 383/210–211, 203–206; 426/124, 122–123, 106, 119; 428/40.1, 41.7–41.8, 42.1; 229/87.05, 87.08

(56) References Cited

U.S. PATENT DOCUMENTS 1,171,462 A * 2/1916 Rice ..... 229/87.05
3,235,165 A 2/1966 Jackson
3,272,422 A 9/1966 Miller (Continued)

FOREIGN PATENT DOCUMENTS

EP 0 474 981 A1 3/1992
FR 1327914 5/1963

OTHER PUBLICATIONS

Patent Abstracts of Japan, vol. 1997, No. 10, Oct. 31, 1997 & JP 09 156677 A (Fuji Seal Co Ltd), (Jul. 6, 1997) abstract in English and 7 figures.

*Primary Examiner*—Bryon P. Gehman
(74) *Attorney, Agent, or Firm*—Stites & Harbison PLLC; Marvin Petry

(57) ABSTRACT

A container for a food product includes a wrapper which surrounds a frame. The container can be any polygonal shape which is defined by the shape of the frame. The wrapper forms a top of the container which has an access opening. A sealing layer is adhesively sealed to the top around the opening. The sealing layer is resealable when a tab of the sealing layer is pulled back. The sealing layer is resealable against the top layer to seal the opening when the sealing layer is moved back to a flat position on the top. Various tamper-evident structures are provided to indicate when the container has been initially opened or tampered with.

25 Claims, 7 Drawing Sheets

U.S. PATENT DOCUMENTS 3,740,238 A 6/1973 Graham
3,966,046 A * 6/1976 Deutschlander ..... 229/87.08
4,420,080 A 12/1983 Nakamura
4,464,154 A 8/1984 Ljungcrantz
4,548,824 A * 10/1985 Mitchell et al. ..... 426/111
4,548,852 A * 10/1985 Mitchell ..... 426/111
4,552,269 A 11/1985 Chang
4,648,509 A * 3/1987 Alves ..... 229/164.1
4,651,874 A 3/1987 Nakamura
4,679,693 A 7/1987 Forman
4,723,301 A 2/1988 Chang
4,790,436 A 12/1988 Nakamura
4,840,270 A 6/1989 Caputo et al.
4,848,575 A 7/1989 Nakamura et al.
4,865,198 A * 9/1989 Butler ..... 206/459.1
4,876,123 A * 10/1989 Rivera et al. ..... 428/34.2
4,917,247 A * 4/1990 Jud ..... 229/87.05
5,048,718 A 9/1991 Nakamura
5,100,003 A * 3/1992 Jud ..... 229/87.05
5,344,007 A 9/1994 Nakamura et al.
5,388,757 A 2/1995 Lorenzen
5,503,858 A * 4/1996 Reskow ..... 426/106
5,647,506 A 7/1997 Julius
5,664,677 A 9/1997 O'Connor
5,688,394 A 11/1997 McBride, Jr. et al.
5,725,311 A 3/1998 Ponsi et al.
D394,605 S 5/1998 Skiba et al.
5,791,465 A 8/1998 Niki et al.
5,938,013 A 8/1999 Palumbo et al.
5,945,145 A * 8/1999 Narsutis et al. ..... 426/123
5,956,794 A 9/1999 Skiba et al.
6,026,953 A 2/2000 Nakamura et al.
6,029,809 A 2/2000 Skiba et al.
6,113,271 A 9/2000 Scott et al.
6,126,009 A 10/2000 Shiffler et al.
6,164,441 A 12/2000 Guy et al.
D447,054 S 8/2001 Hill
6,273,610 B1 8/2001 Koyama et al.
6,309,105 B1 10/2001 Palumbo
6,420,006 B1 7/2002 Scott
6,428,867 B1 * 8/2002 Scott et al. ..... 428/40.1
6,461,708 B1 10/2002 Dronzek
2002/0182359 A1 12/2002 Muir, Jr. et al.
2004/0067326 A1 4/2004 Knoerzer et al.
2004/0083680 A1 5/2004 Compton et al.

* cited by examiner

RESEALABLE FOOD CONTAINER

FIELD OF THE INVENTION

The present invention relates to a resealable container, and in particular, a new and improved resealable container having a reclosable sealing layer which can be pulled back and reclosed against a top portion of the container.

BACKGROUND OF THE INVENTION

Containers for food products such as cookies and other snacks typically include a frame surrounded by an outer wrapper. The frame acts as a tray to hold the food product and to protect the food product from damage. One normally gains access to the contents of the container by opening one end of the wrapper, withdrawing the tray from the inside thereof, and then removing the food product from the tray. However, these containers generally do not provide a convenient opening and reclosing arrangement. For example, reclosing of the wrapper, once opened, generally includes simply folding or rolling the end down and clipping the end to keep the wrapper closed.

Reclosable seals have been used for dispensing bags for wet tissue or disposable cleaning wipes. The label on these bags can be pulled back thereby exposing an opening, allowing access to the wet tissues or wipes inside. Typically, these dispensing bags are completely flexible, formed exclusively of a plastic or other suitable flexible material which closely surrounds the pack of wet tissues or wipes. Examples of these dispensing bags include U.S. Pat. Nos. 4,840,270 and 6,026,953, U.S. Design Pat. No. D 447,054 and U.S. Patent Application Publication No. 2002/0182359. However, such known dispensing bags are not well suited for containing food products as these containers fail to provide adequate protection for storing food products.

SUMMARY OF THE INVENTION

The purpose of the present invention is to provide a new and improved container for food products such as rigid food articles, for example cookies and the like, which container provides adequate protection for the contents thereof, while concurrently facilitating opening of the container wrapper and resealing the seal to protect the contents thereof until the contents are fully consumed.

This purpose is achieved by providing a suitable container for such food products, in combination with an easily accessible opening seal formed in a surface other than an end surface, which seal can reclose the container during use.

In accordance with one embodiment, the present invention comprises a polygonal shaped food container having a frame defining the polygonal shape of the container which contains the food product. A wrapper surrounds the frame and forms a top of the container. The top has an access opening so as to provide hand access to food contents of the container. A sealing layer is adhesively sealed to the top around the opening. The sealing layer is releasable from the top when a starter portion, for example, a tab of the sealing layer is pulled back and is reclosable against the top to seal the opening when the sealing layer is moved back to a flat position on the top.

In accordance with a further form of the present invention, the food container includes a tamper-evident structure. In various different alternate embodiments, the tamper-evident structure may include tamper-evident tape or scored seal tape extending along at least a portion of a perimeter where the scoring tape contacts the top, a removable film disposed under the sealing layer, a membrane sleeve encircling the wrapper over the sealing layer, or an overwrap surrounding the wrapper.

In accordance with another aspect of the present invention, a rectangular food container includes a frame defining the rectangular shape of the container which contains the food product. A wrapper surrounds the frame and forms a top of the container. The top has an access opening so as to provide hand access to food contents of the container. A sealing layer is adhesively sealed to the top around the opening. The sealing layer is releasable from the top when a tab of the sealing layer is pulled back and reclosable against the top to seal the opening when the sealing layer is moved back to a flat position on the top.

In accordance with another aspect of the present invention, a polygonal shaped food container comprises a frame defining the polygonal shape of the container which contains the food product. A wrapper surrounds the frame and forms a top of the container. The top has an access opening so as to provide hand access to food contents of the container. A sealing layer is adhesively sealed to the top around the opening. The sealing layer is releasable from the top when a tab of the sealing layer is pulled back and reclosable against the top to seal the opening when the sealing layer is moved back to a flat position on the top. A tamper-evident structure is associated with the sealing layer.

BRIEF DESCRIPTION OF THE DRAWINGS

The invention will now be described in detail with respect to preferred embodiments with reference to the accompanying drawings, wherein.

DETAILED DESCRIPTION OF THE INVENTION

Figure 1:
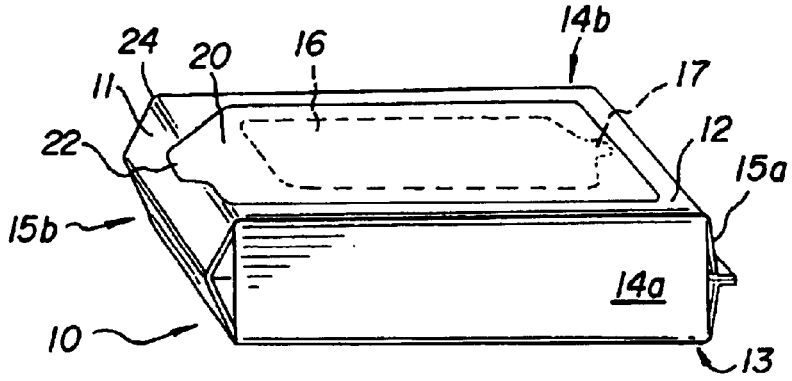
FIG. 1 is a perspective view of a resealable container in a closed configuration in accordance with the present invention.

Referring now to the drawings, like numbers represent like elements throughout the several views.

Figure 2:
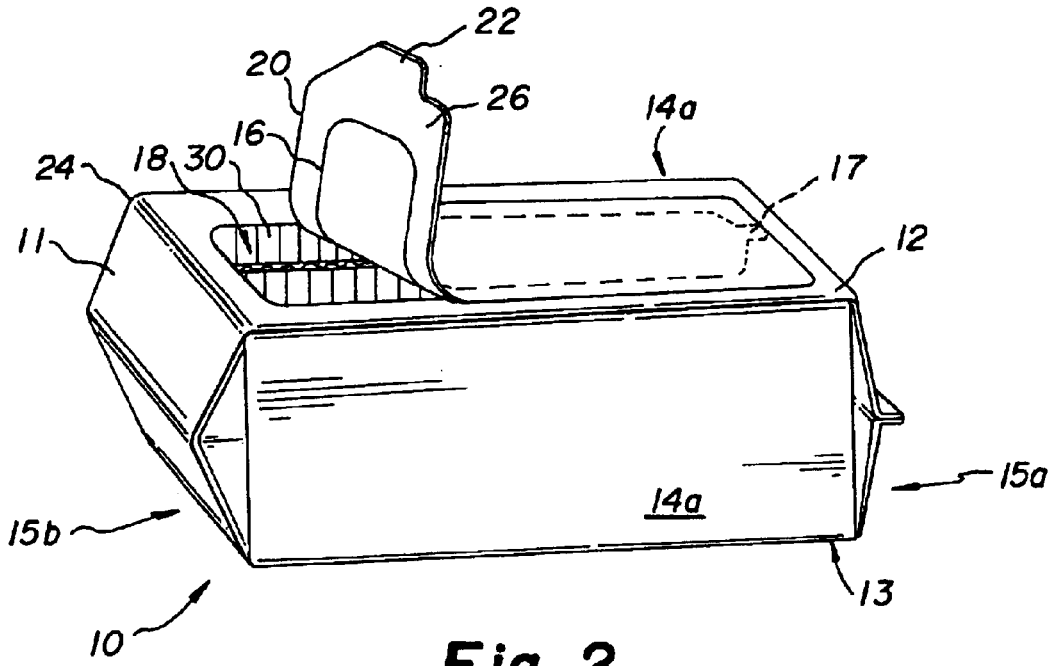
FIG. 2 is a perspective view of the container of FIG. 1 in a partially opened configuration.

Referring now specifically to FIGS. 1 and 2, resealable container 10 includes a wrapper 11 which forms top 12, bottom 13, opposing sides 14*a* and 14*b*, and opposing ends 15*a* and 15*b*. The top 12 has a flap 16 with a tapered end 17. The flap 16, when pulled back from the container 10, forms an opening 18.

A sealing layer 20 is affixed to the flap 16. Advantageously, the sealing layer 20 is permanently affixed to the flap 16 using an appropriate adhesive. The sealing layer 20 covers a substantial portion of the top 12 extending from the proximity of end 15*b* to the proximity of end 15*a*.

Graphics may be formed on the sealing layer 20 which align with corresponding graphics on top 12 when the sealing layer 20 is sealed or in a flat position on top 12. Alternatively, sealing layer 20 may be transparent, allowing graphics of top 12 to be visible through sealing layer 20.

A starter portion, for example a tab 22 extends or projects past coner 24. As a result, tab 22 can be grasped from above and below by ones fingers and/or thumb thereby the tab 22 is easily accessible for one to pull.

Adhesive 26 is applied to the surface of sealing layer 20 which is in contact with top 12. Advantageously, the adhesive 26 provides a removable seal between the sealing layer 20 and top 12.

Container 10 is transformed from a closed configuration depicted in FIG. 1 to a partially opened configuration depicted in FIG. 2 by grasping the tab 22 between ones fingers and/or thumb and pulling back on the sealing layer 20 to gain access to opening 18. Once container 10 is opened, one can remove individual food product contained inside the container 10 through opening 18.

Figure 3:
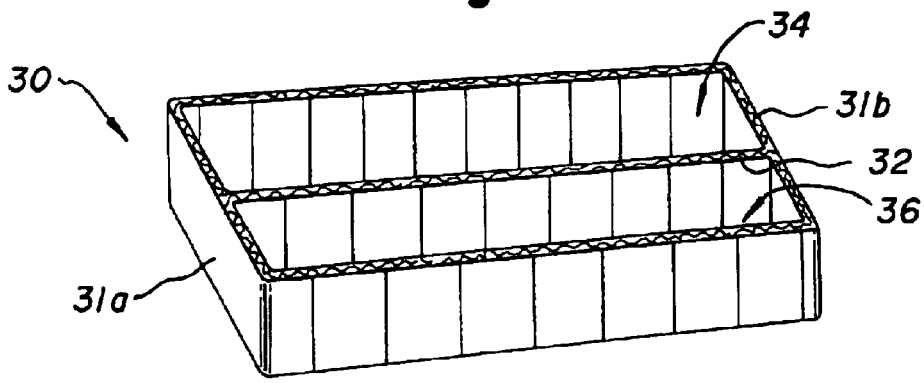
FIG. 3 is a perspective view of a frame of the container of FIGS. 1 and 2.

Wrapper 11 surrounds a frame 30 which forms a tray for the contents of the food to be placed. Referring to FIG. 3, the frame 30 is composed of a rigid material which forms the shape of the container 10. Suitable rigid material includes plastics and cardboard. Frame 30 includes ends 31*a* and 31*b* a divider 32 which divides the frame 30 into a first section 34 and a second section 36.

Frame 30 can be any polygonal shape such as the rectangular shape depicted in FIG. 3. Accordingly, the rectangularly shaped frame 30 forms a rectangularly shaped container 10. Alternately, different polygonal shaped frames will form containers having the corresponding polygonal shape.

In various further embodiments, tamper-evident structure are provided in an effort to indicate whether the container 10 has been previously opened or in some manner been tampered with.

Figure 4A:
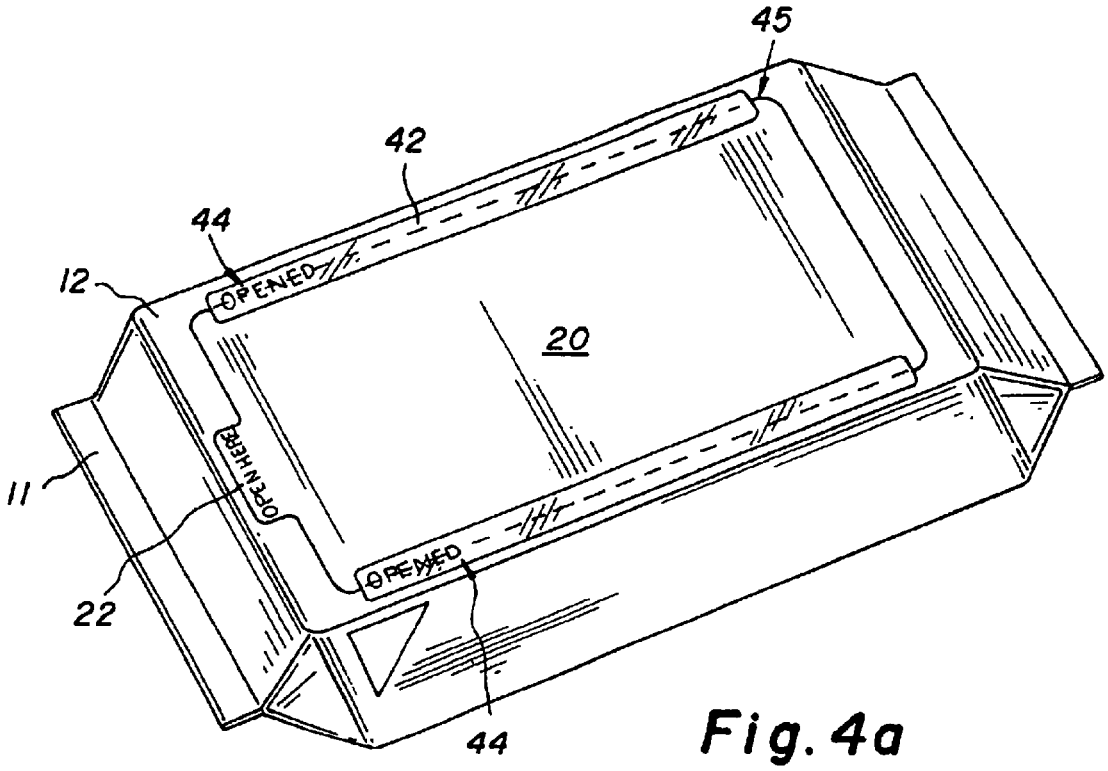
FIG. 4*a* is a perspective view of a resealable food container having tamper-evident tape extending along a portion of a top of the container with the container depicted in a sealed configuration.
Figure 4B:
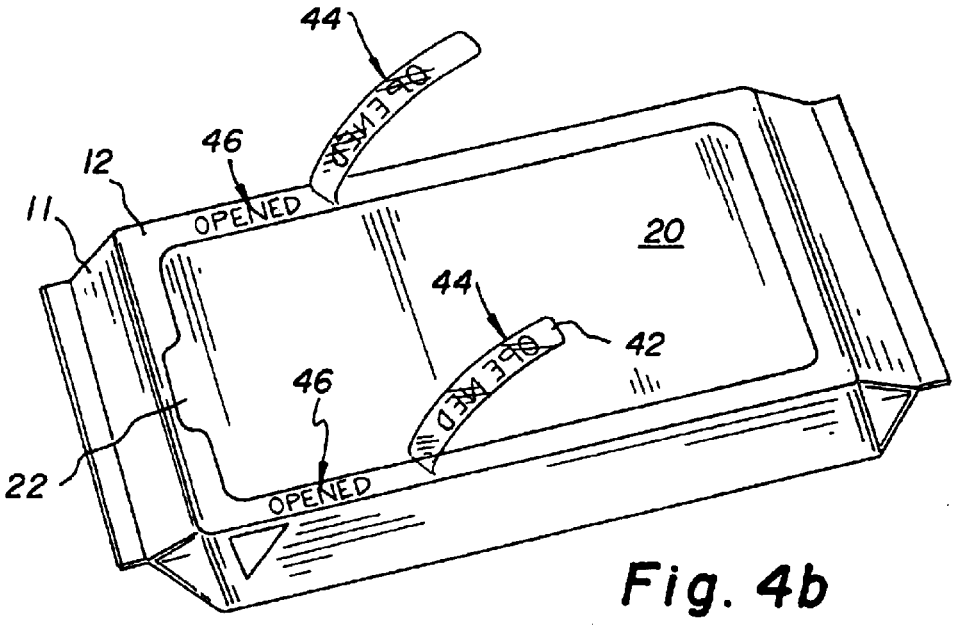
FIG. 4*b* is a perspective view of the container of FIG. 4*a* with the tamper-evident tape partially withdrawn.

Referring to FIGS. 4*a* and 4*b*, in one form, the tamper-evident structure includes tamper-evident tape 42 which is applied along two portions of the perimeter 45 where the sealing layer 20 contacts the top 12. The tamper-evident tape 42 must be removed prior to or at the same time the sealing layer 20 is pulled back for the first time. Once the tamper-evident tape 42 is peeled back from the wrapper 11, indicia 44 from the tamper-evident tape 42 remains on the top 20 as evidence that the tamper-evident tape 42 had been previously removed. For example, the indicia of lettering "OPENED" 46 in FIG. 4*b* evidences that the tamper-evident tape 42 has been removed.

Figure 5A:
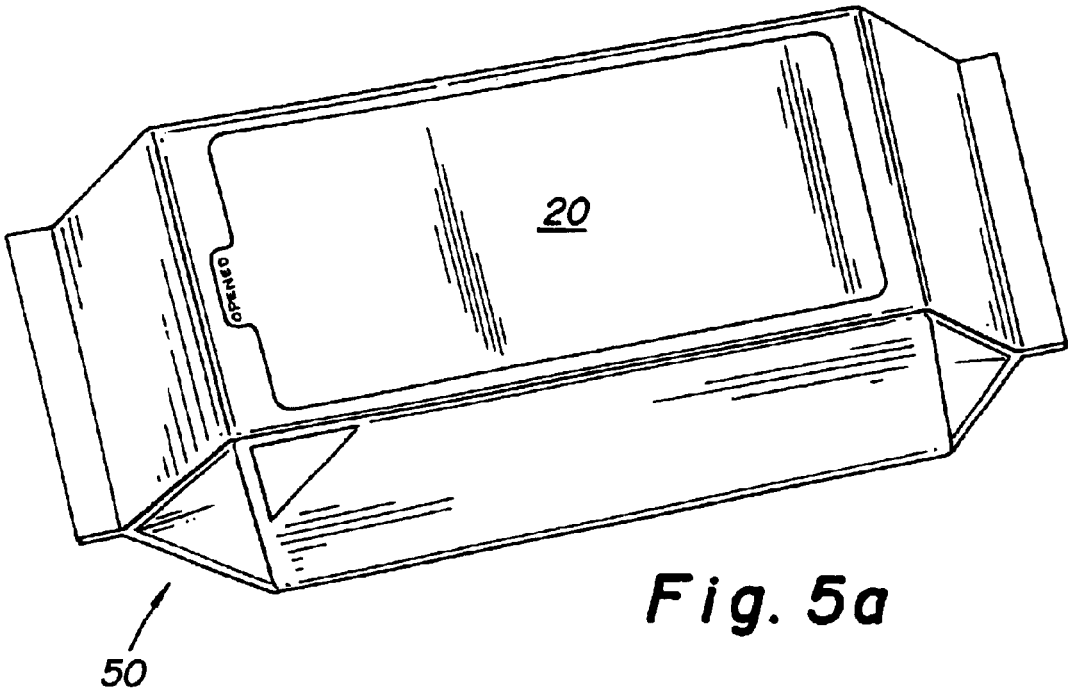
FIG. 5*a* is a perspective view of a resealable container with a tamper-evident removable film where the container is depicted in an unopened configuration.
Figure 5B:
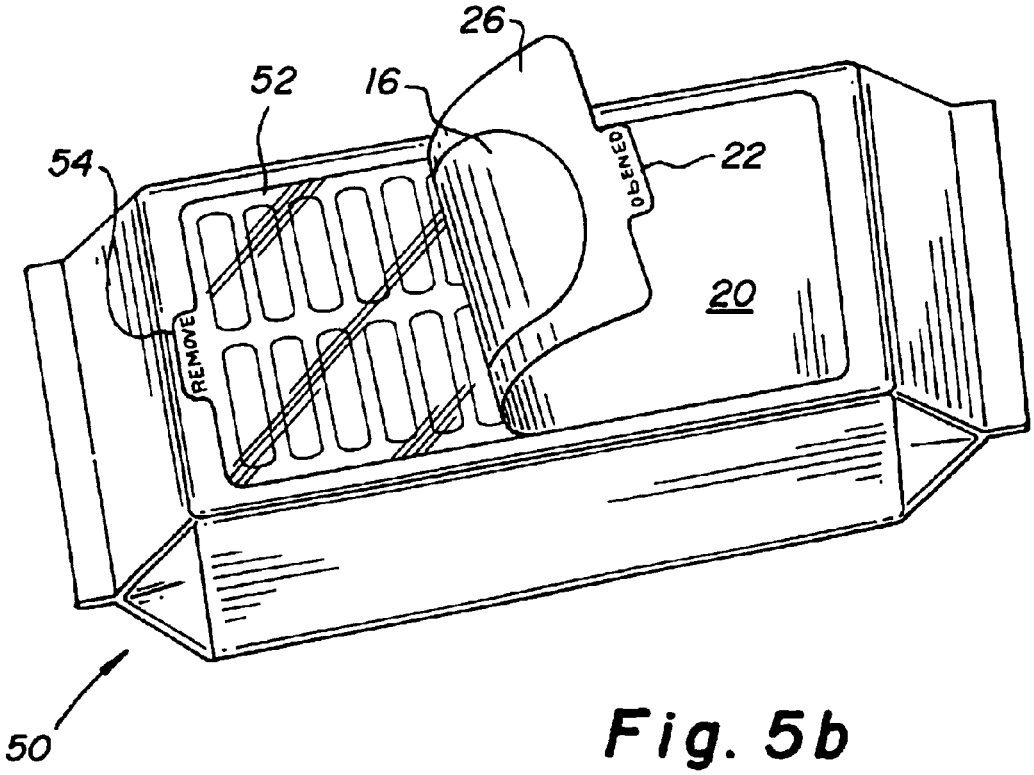
FIG. 5*b* is a perspective view of the container of FIG. 5*a* depicted in a partially opened configuration.

Referring to FIGS. 5*a* and 5*b*, in an alternative tamper-evident structure, container 50 includes a film 52 disposed under the sealing label 20. The film 52 may be plastic or foil and includes a film tab 54 which one pulls to remove the film 52. In use, one opens the container 50 as container 10 and then removes and discards the removable film 52 to gain access to the food contents contained within the container 50. To reseal the container 50, sealing layer 20 is moved back to a flat position as depicted in FIG. 5*a*.

Figure 6:
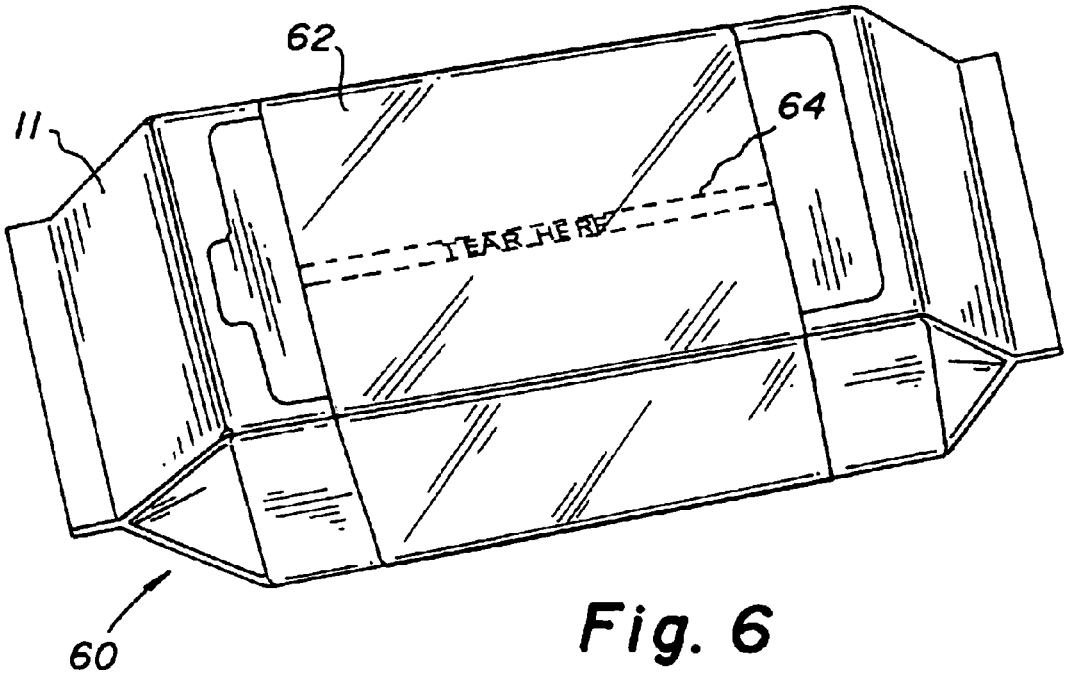
FIG. 6 is a perspective view of a resealable container having a tamper-evident membrane sleeve encircling the container.

Referring now to FIG. 6, in an alternative tamper evident structure, container 60 includes a membrane sleeve 62 which is shrink wrapped around the wrapper 11. A pair of parallel perforations 64 are scored in the membrane sleeve 62 which allow one to tear open the membrane along the perforations 64. After the membrane sleeve 62 has been removed, the membrane sleeve 62 is discarded. Then, one opens the container 60 as container 10 as previously described.

Figure 7:
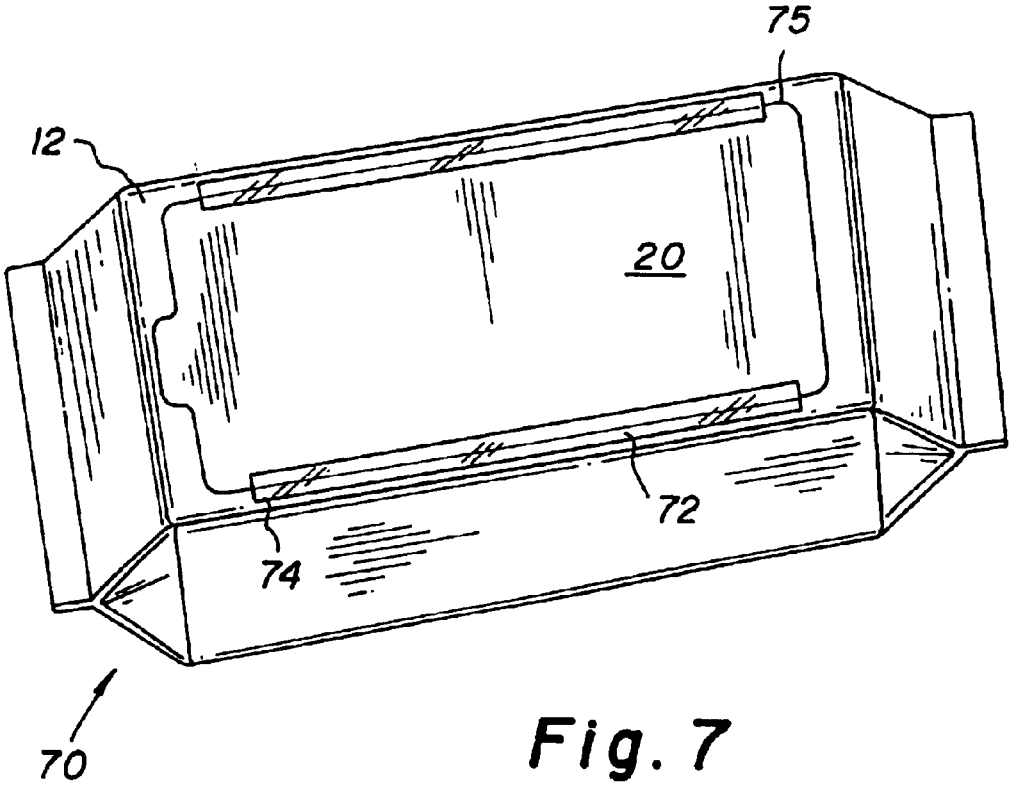
FIG. 7 is a perspective view of a resealable container having a tamper-evident scored seal tape extending along a portion of a top of the container.

Referring now to FIG. 7, in yet another tamper-evident structure includes scored seal tape 72 which is placed along two portions of the perimeter 75 where the sealing layer 20 contacts the top 12. When the sealing layer 20 is pulled back from the top 12 for the first time, portion 74 of the scored seal tape 72 remains on top 12 thereby indicating that the seal layer 20 previously has been removed from the container 70.

Figure 8:
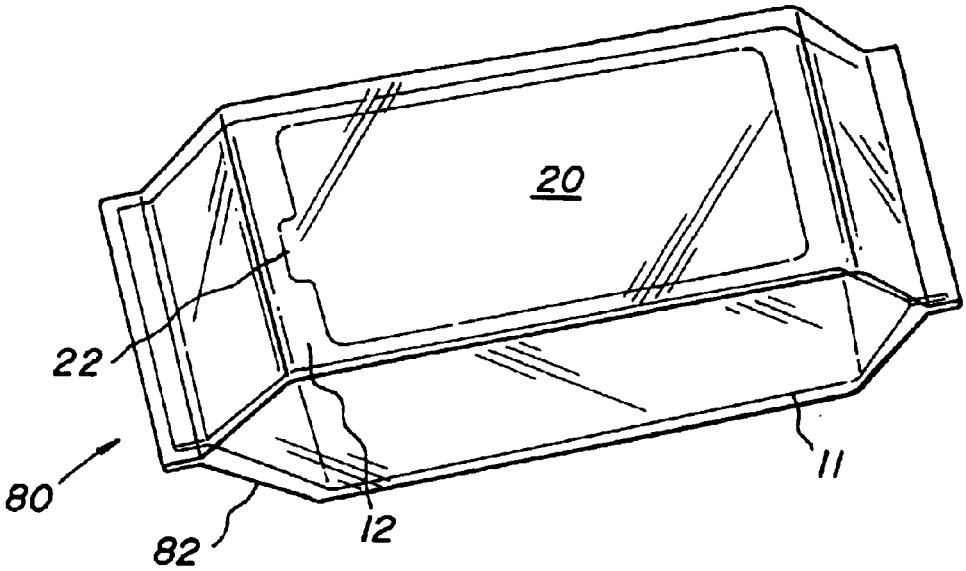
FIG. 8 is a perspective view of a resealable food container having a tamper-evident overwrap surrounding the container.

Referring now to FIG. 8, in yet another tamper-evident structure, container 80 includes an overwrap 82 which completely surrounds the wrapper 11. To gain access to the food product in container 80, one breaks open and discards overwrap 82. Then, one opens the container 80 as container 10 by pulling back on tab 22 to withdraw sealing layer 20 from the top 12.

Figure 9:
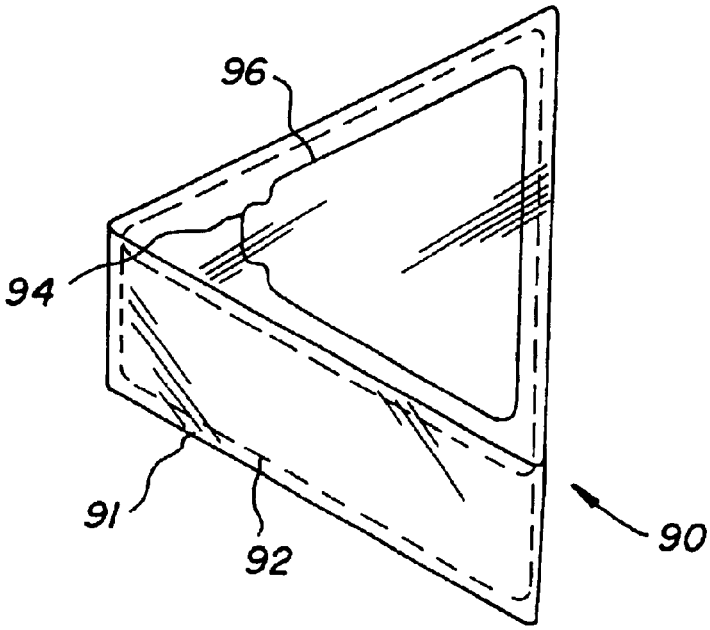
FIG. 9 is a perspective view of a polygonal shaped resealable food container in accordance with another embodiment of the present invention.
Figure 10:
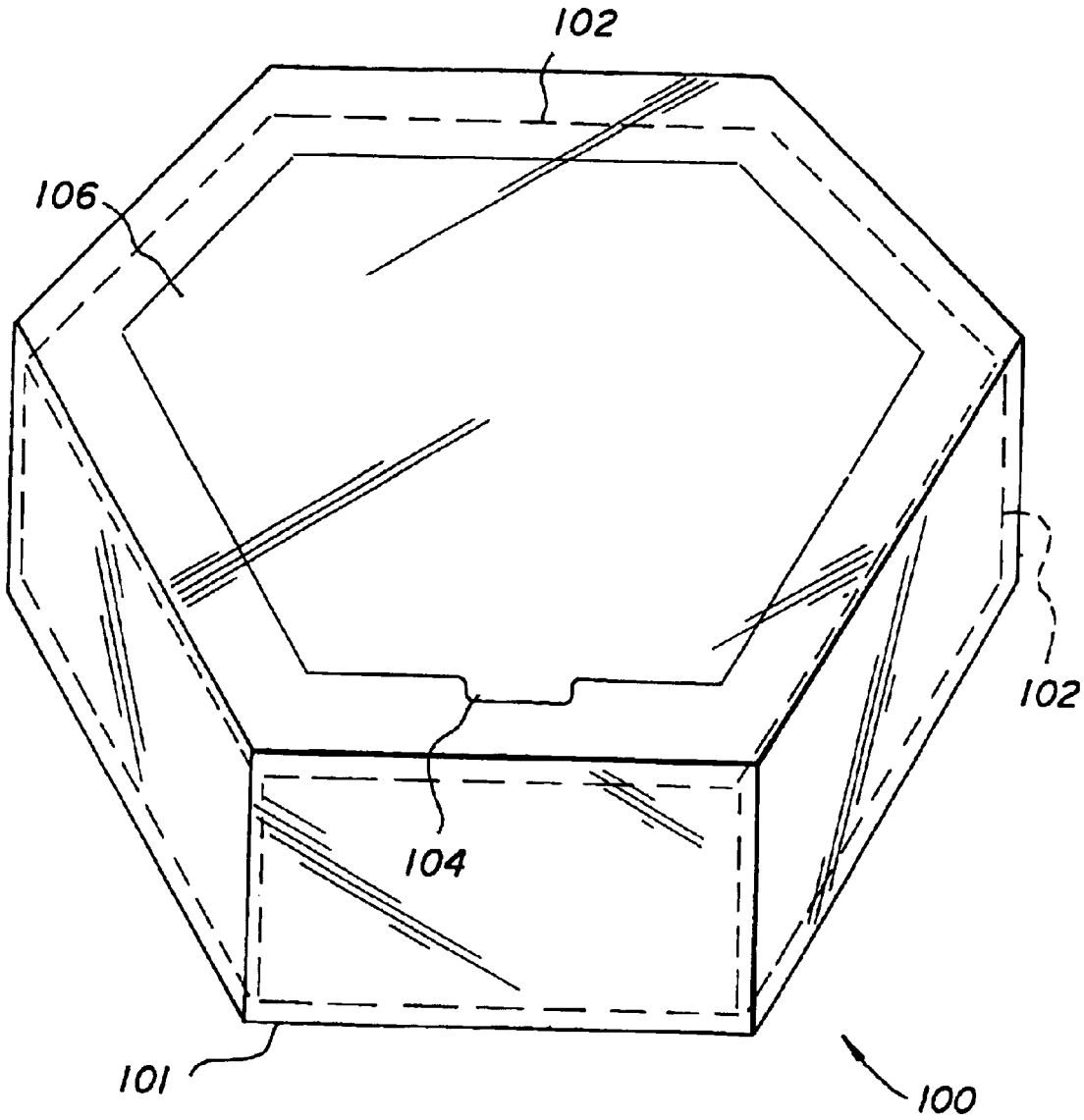
FIG. 10 is a perspective view of a different polygonal shaped resealable food container.

In an alternative embodiment, rather than a rectangular container, the container may be in the form of any polygonal shaped container although rectangular which includes square is the preferred polygonal shape. As previously discussed, the polygonal shape of the container takes its form from the frame which is covered by a wrapper. For example, referring to FIG. 9, container 90 is a triangular shaped polygonal container formed by wrapper 91 surrounding frame 92. In an alternative polygonal shape depicted, FIG. 10 depicts container 100 in the shape of a hexagon defined by wrapper 101 which surrounds frame 102. As in the embodiment of FIGS. 1 and 2, one gains access to the contents of containers 90,100 by pulling back on tabs 94,104 of sealing layer 96,106, respectively.

Figure 12:
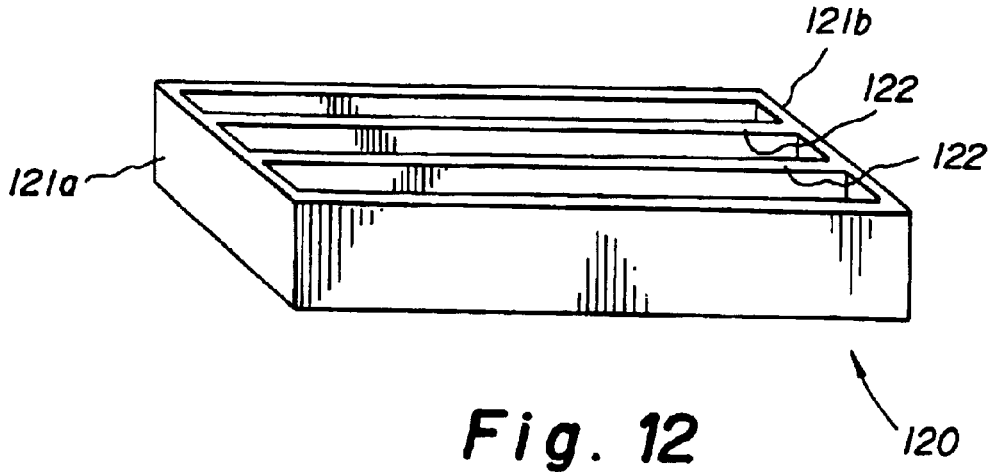
FIG. 12 is a perspective view of another frame for a resealable food container.
Figure 11:
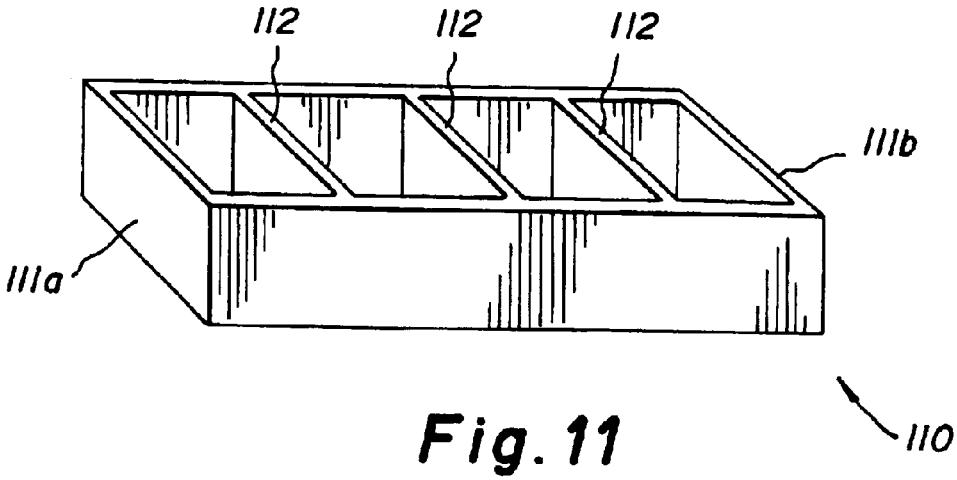
FIG. 11 is a perspective view of a frame for a resealable food container in accordance with the present invention.
Figure 13:
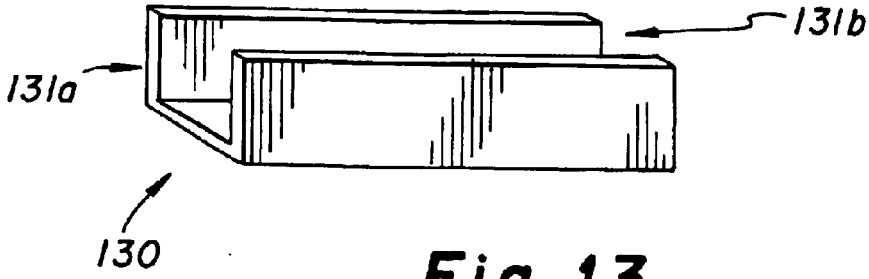
FIG. 13 is a perspective view of another different frame for a resealable food container.

In other alternative embodiments, other frames other than frame 30 which has a single divider 32, extending longitudinally along the length of the frame 30 can be used to form resealable containers. For example, referring to FIG. 11, frame 110 includes a plurality of dividers 112 which extend transversely across the width of the frame 110. Alternatively, frame 120 includes a plurality of dividers 122 extending transversely across the frame 120 (FIG. 12) and frame 130 (FIG. 13) does not include a divider at all. Selection of a particular frame depends on the desired use. Further, the various frames may include ends such as frames 30,110 and 120 which have ends 31*a*,31*b*, 111*a*,111*b*, 121*a*,121*b*; or the frame may be opened at the ends such as frame 130 with opened ends 131*a*,131*b*.

The present invention offers numerous features and advantages over previous food containers. For example, in one form, the present invention includes a tab element which extends beyond a corner of a top or side of the container which makes the tab easily accessible for being grasped and for withdrawing a sealing layer from the container.

An additional feature of the present invention is provided by a resealable sealing layer which can be pulled back and then resealable against a top portion of the container. This configuration makes it possible to gain easy access to the food product within the container without having to open the end of the container, withdraw a tray containing the food product, remove the food product from the tray, return the tray back to the container, and close off the end of the bag.

A further feature of one form of the present invention is provided by a tamper-evident structure which indicates whether the container has been previously opened or otherwise tampered. This tamper-evident structure allows a consumer to know whether the container has been previously opened. Further, the tamper-evident structure helps ensure that the contents are fresh by indicating whether the container has been previously opened.

Although the invention has been described in detail with respect to the preferred embodiments thereof, it will be apparent to one of ordinary skilled in the art that the invention is capable of numerous modifications and variations within the scope and spirit of the invention.

What is claimed is:

1. A polygonal shaped food container comprising:

a frame defining the polygonal shape of the container, said container having a top, a bottom and sides connecting the top and bottom, the frame containing a food product comprised of discrete food articles;

a wrapper surrounding said frame, said wrapper forming the top sides and bottom of the container;

said top having an access opening sufficiently large to provide hand access to substantially all of the discrete food articles contained within the frame, such that substantially any one of the discrete food articles can be accessed and removed individually through said access opening; and a sealing layer, adhesively sealed to said top around said opening, said sealing layer including a starter portion located near a side of the top which can be grasped by a user, said sealing layer being releasable when said starter portion is pulled in a direction away from said side to in turn pull and thereby release at least a portion of said sealing layer to provide the hand access to said top access opening and reclosable against said top to seal said opening when said sealing layer is moved back against the said top.

2. The polygonal shaped food container of claim 1, wherein said top of said wrapper comprises a flap have substantially the same dimension as said opening and affixed to said sealing layer.

3. The polygonal shaped food container of claim 1, wherein said starter portion comprises a tab which projects past an edge of said top at one side of the container, said tab being accessible beyond the edge to be grasped.

4. The polygonal shaped food container of claim 1, wherein said top of the container includes graphics around said opening, and said sealing layer includes graphics which match the graphics on said top.

5. The polygonal shaped food container of claim 1, wherein said sealing layer is transparent.

6. The polygonal shaped food container of claim 1, further comprising a tamper-evident structure.

7. The polygonal shaped food container of claim 6, wherein said tamper-evident structure comprises tape extending along at least a portion of a perimeter where said sealing layer contacts said top, along both said sealing layer and said top, said tape having to be removed prior to or at the same time said sealing layer is pulled back for a first time, said tape leaving an indicia on said top after said tape is removed.

8. The polygonal shaped food container of claim 6, wherein said tamper-evident structure comprises a removable film disposed under said sealing layer, said film having to be removed to gain access to the contents of the container.

9. The polygonal shaped food container of claim 6, wherein said tamper-evident structure comprises a membrane sleeve encircling said wrapper over said sealing layer, said membrane sleeve having to be removed prior to pulling back said sealing layer.

10. The polygonal shaped food container of claim 6, wherein said tamper-evident structure comprises scored seal tape extending along at least a portion of a perimeter where said sealing layer contacts said top, along both said sealing layer and said top, said scored tape having to be removed prior to or at the same time said sealing layer is pulled back for a first time, said scored seal tape leaving a portion of the scored seal tape on said top after said scored seal tape is removed.

11. The polygonal shaped food container of claim 6, wherein said tamper-evident structure comprises an overwrap surrounding said wrapper.

12. The polygonal shaped food container of claim 1, wherein said starter portion comprises a tab.

13. A rectangular food container comprising:

a frame defining the rectangular shape of the container, said container having a generally rectangular top, a generally rectangular bottom and sides connecting the top and the bottom, said frame containing a food product comprised of discrete food articles;

a wrapper surrounding said frame, said wrapper forming said generally rectangular top of the container;

said top having an access opening sufficiently large to provide hand access to substantially all of the discrete food articles contained within the frame, such that substantially any one of the discrete food articles can be accessed and removed individually through said access opening; and a sealing layer, adhesively sealed to said top around said opening, said sealing layer including a starter portion located near a side of the top which can be grasped by a user, said sealing layer being releasable when said starter portion is pulled in a direction away from said side to in turn pull and thereby release at least a portion of said sealing layer to provide the hand access to said top access opening and reclosable against said top to seal said opening when said sealing layer is moved back against said top.

14. The generally rectangular food container of claim 13, wherein said top of said wrapper comprises a flap have substantially the same dimensions as said access opening and affixed to said sealing layer.

15. The generally rectangular food container of claim 13, wherein said sealing layer covers substantially the entire top.

16. The generally rectangular food container of claim 13, wherein said top of the container includes graphics around said opening, and said sealing layer includes graphics which match the graphics on said top.

17. The generally rectangular food container of claim 13, further comprising a tamper-evident structure.

18. The generally rectangular food container of claim 17, wherein said tamper-evident structure comprises tape extending along at least a portion of a perimeter where said sealing layer contacts said top along both said sealing layer and said top, said tape having to be removed prior or at the same time said sealing layer is pulled back for a first time, said tape leaving an indicia on said top after said tape is removed.

19. The generally rectangular food container of claim 17, wherein said tamper-evident structure comprises a removable film disposed under said sealing layer, said film having to be removed to gain access to the contents of the container.

20. The generally rectangular food container of claim 17, wherein said tamper-evident structure comprises a membrane sleeve encircling said wrapper over said sealing layer, said membrane sleeve having to be removed prior to pulling back said sealing layer.

21. The generally rectangular food container of claim 17, wherein said tamper-evident structure comprises scored seal tape extending along at least a portion of a perimeter where said scored seal tape contacts said top along both said sealing layer and said top, said scored tape having to be removed prior or at the same time said sealing layer is pulled back for a first time, said scored seal tape leaving a portion of the scored tape on said top after said scored tape is removed.

22. The generally rectangular food container of claim 17, wherein said tamper-evident structure an overwrap surrounding said wrapper.

23. The generally rectangular food container according to claim 13, wherein said starter portion comprises a tab.

24. The generally rectangular food container according to claim 23, wherein the tab projects past an edge of the top at a shorter side of the generally rectangular top so as to be accessible to be grasped beyond said edge.

25. The generally rectangular food container according to claim 13, wherein said sealing layer is transparent.

* * * * *

UNITED STATES PATENT AND TRADEMARK OFFICE

CERTIFICATE OF CORRECTION

PATENT NO. : 6,918,532 C1
APPLICATION NO. : 90/008843
DATED : October 25, 2011
INVENTOR(S) : Gladys Odette Sierra-Gomez et al.

It is certified that error appears in the above-identified patent and that said Letters Patent is hereby corrected as shown below:

Column 1, line 22, delete "periphery" and insert --periphery portion--, therefor.

Column 2, line 57, delete "addtional" and insert --additional--, therefor.

Column 3, line 45, delete "claim 47" and insert --claim 46--, therefor.

Signed and Sealed this
Thirteenth Day of March, 2012

David J. Kappos
*Director of the United States Patent and Trademark Office*

US006918532C1

(12) EX PARTE REEXAMINATION CERTIFICATE (8638th)

United States Patent
Sierra-Gomez et al.

(10) Number: US 6,918,532 C1
(45) Certificate Issued: Oct. 25, 2011

(54) RESEALABLE FOOD CONTAINER

(75) Inventors: Gladys Odette Sierra-Gomez, Woodbridge, NJ (US); Eva Marie Peters, Cedar Grove, NJ (US); Joseph Stiener, Warren, NJ (US); Charles Francis Flynn, IV, Oak Ridge, NJ (US); James Spencer Mandle, Woodcliff Lake, NJ (US)

(73) Assignee: Kraft Foods Holdings, Inc., Northfield, IL (US)

Reexamination Request:
No. 90/008,843, Oct. 17, 2007

Reexamination Certificate for:

| | |
|---|---|
| Patent No.: | **6,918,532** |
| Issued: | **Jul. 19, 2005** |
| Appl. No.: | **10/414,502** |
| Filed: | **Apr. 16, 2003** |

(51) Int. Cl.

| | |
|---|---|
| ***B65D 65/26*** | (2006.01) |
| ***B65D 75/28*** | (2006.01) |
| ***B65D 85/00*** | (2006.01) |
| ***B65D 25/10*** | (2006.01) |

(52) U.S. Cl. ..... 229/87.08; 229/87.05; 206/459.1; 383/203; 383/205; 426/119

(58) Field of Classification Search ..... None
See application file for complete search history.

(56) References Cited

U.S. PATENT DOCUMENTS

| | | | |
|---|---|---|---|
| 811,092 | A | 1/1906 | Roberts |
| 1,065,012 | A | 6/1913 | Watanabe |
| 1,106,721 | A | 8/1914 | Lewis |
| 1,791,352 | A | 2/1931 | Pascual |
| 1,963,639 | A | 6/1934 | Ahlquist |
| 1,978,035 | A | 10/1934 | Thom |
| 2,066,495 | A | 1/1937 | Swift |
| 2,128,196 | A | 8/1938 | Vogel |
| 2,475,236 | A | 7/1949 | Gollab |
| 2,554,160 | A | 5/1951 | Von Gunten |

(Continued)

FOREIGN PATENT DOCUMENTS

| | | |
|---|---|---|
| AU | 2002334419 | 5/2003 |
| AU | 768679 | 12/2003 |
| DE | 90 14 065 | 2/1991 |
| DE | 4134567 | 1/1993 |
| EP | 388310 | 9/1990 |
| EP | 0447636 | 9/1991 |
| EP | 0488967 | 6/1992 |
| EP | 0546369 | 6/1993 |
| EP | 0613824 | 9/1994 |
| EP | 0 629 561 | 12/1994 |

(Continued)

OTHER PUBLICATIONS

40 Packaging News PPMA Preview Sep. 2001.
Machinery Update, Mar./Apr. 2002, pp. 59–60.
"Elite Edam Cheese", *Mintel gnpd*, Dec. 3, 2001, Mintel Publishing.
"New Easy Peel Cheese Packaging", *Mintel gnpd*, Aug. 10, 2001, Mintel Publishing.
"Cheese Rage", *Mintel gnpd*, Jan. 26, 2001, Mintel Publishing.
"Soft Bread Sticks", *Mintel gnpd*, Mar. 20, 1998, Mintel Publishing.

(Continued)

*Primary Examiner*—Jeffrey L. Gellner

(57) ABSTRACT

A container for a food product includes a wrapper which surrounds a frame. The container can be any polygonal shape which is defined by the shape of the frame. The wrapper forms a top of the container which has an access opening. A sealing layer is adhesively sealed to the top around the opening. The sealing layer is resealable when a tab of the sealing layer is pulled back. The sealing layer is resealable against the top layer to seal the opening when the sealing layer is moved back to a flat position on the top. Various tamper-evident structures are provided to indicate when the container has been initially opened or tampered with.

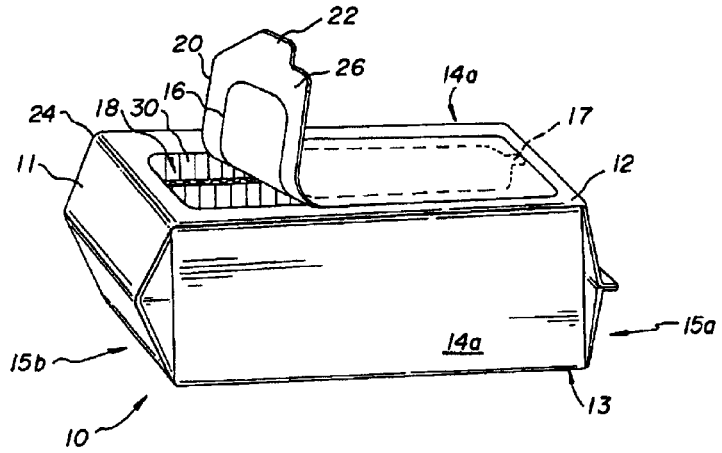

U.S. PATENT DOCUMENTS

| | | | | | |
|---|---|---|---|---|---|
| 2,684,807 | A | | 7/1954 | Gerrish | |
| 2,965,224 | A | | 12/1960 | Harwood | |
| 3,080,238 | A | | 3/1963 | Howard et al. | |
| 3,127,273 | A | | 3/1964 | Monoham | |
| 3,179,326 | A | | 4/1965 | Underwood et al. | |
| 3,186,628 | A | | 6/1965 | Rohde | |
| 3,187,982 | A | | 6/1965 | Underwood et al. | |
| 3,260,358 | A | | 7/1966 | Gottily et al. | |
| 3,311,032 | A | | 3/1967 | Lucas | |
| 3,331,501 | A | | 7/1967 | Steward, Jr. | |
| 3,343,541 | A | | 9/1967 | Bellemy, Jr. | |
| 3,373,926 | A | | 3/1968 | Voightman, Sr. et al. | |
| 3,454,210 | A | | 7/1969 | Spiegel et al. | |
| 3,528,825 | A | | 9/1970 | Doughty | |
| 3,595,468 | A | | 7/1971 | Repko | |
| 3,618,751 | A | | 11/1971 | Rich | |
| 3,651,615 | A | | 3/1972 | Bohner et al. | |
| 3,687,352 | A | | 8/1972 | Kalajian | |
| 3,740,238 | A | * | 6/1973 | Graham | 426/124 |
| 3,885,727 | A | * | 5/1975 | Gilley | 229/407 |
| 3,905,646 | A | | 9/1975 | Brackmann et al. | |
| 3,910,410 | A | | 10/1975 | Shaw | |
| 3,938,659 | A | | 2/1976 | Wardwell | |
| 4,156,493 | A | | 5/1979 | Julius | |
| 4,185,754 | A | | 1/1980 | Julius | |
| 4,192,420 | A | | 3/1980 | Worrell et al. | |
| 4,192,448 | A | | 3/1980 | Porth | |
| 4,197,949 | A | | 4/1980 | Carlsson | |
| 4,258,876 | A | | 3/1981 | Ljungcrantz | |
| 4,260,061 | A | | 4/1981 | Jacobs | |
| 4,273,815 | A | | 6/1981 | Gifford et al. | |
| 4,306,367 | A | | 12/1981 | Otto | |
| 4,364,478 | A | | 12/1982 | Tuns | |
| 4,397,415 | A | * | 8/1983 | Lisiecki | 229/223 |
| 4,411,365 | A | | 10/1983 | Horikawa et al. | |
| 4,488,647 | A | | 12/1984 | Davis | |
| 4,518,087 | A | | 5/1985 | Goglio | |
| 4,538,396 | A | | 9/1985 | Nakamura | |
| 4,549,063 | A | | 10/1985 | Ang et al. | |
| 4,550,831 | A | | 11/1985 | Whitford | |
| 4,557,505 | A | | 12/1985 | Schaefer et al. | |
| 4,570,820 | A | | 2/1986 | Murphy | |
| 4,572,377 | A | | 2/1986 | Beckett | |
| 4,608,288 | A | | 8/1986 | Spindler | |
| 4,610,357 | A | | 9/1986 | Nakamura | |
| 4,616,470 | A | | 10/1986 | Nakamura | |
| 4,625,495 | A | | 12/1986 | Holovach | |
| 4,638,911 | A | | 1/1987 | Prohaska | |
| 4,653,250 | A | | 3/1987 | Nakamura | |
| 4,667,453 | A | | 5/1987 | Goglio | |
| 4,671,453 | A | * | 6/1987 | Cassidy | 206/485.1 |
| 4,673,085 | A | | 6/1987 | Badouard et al. | |
| 4,694,960 | A | | 9/1987 | Phipps et al. | |
| 4,696,404 | A | | 9/1987 | Corella | |
| 4,738,365 | A | | 4/1988 | Prater | |
| 4,739,879 | A | | 4/1988 | Nakamura | |
| 4,784,885 | A | | 11/1988 | Carespodi | |
| 4,790,436 | A | * | 12/1988 | Nakamura | 206/449 |
| 4,798,295 | A | | 1/1989 | Rausing | |
| 4,798,296 | A | | 1/1989 | Lagerstedt et al. | |
| 4,799,594 | A | | 1/1989 | Blackman | |
| 4,811,848 | A | | 3/1989 | Jud | |
| 4,818,120 | A | | 4/1989 | Addiego | |
| 4,838,429 | A | | 6/1989 | Fabisiewicz et al. | |
| 4,845,470 | A | | 7/1989 | Boldt et al. | |
| 4,863,064 | A | | 9/1989 | Dailey, III | |
| 4,866,911 | A | | 9/1989 | Grindrod et al. | |
| 4,874,096 | A | * | 10/1989 | Tessera-Chiesa | 383/5 |
| 4,902,142 | A | | 2/1990 | Lammert et al. | |
| 4,943,439 | A | | 7/1990 | Andreas et al. | |
| 4,972,953 | A | * | 11/1990 | Friedman et al. | 206/459.1 |
| 4,998,666 | A | | 3/1991 | Ewan | |
| 5,000,320 | A | | 3/1991 | Kuchenbecker | |
| 5,005,264 | A | | 4/1991 | Breen | |
| 5,029,712 | A | | 7/1991 | O'Brien | |
| 5,046,621 | A | | 9/1991 | Bell | |
| 5,060,848 | A | | 10/1991 | Ewan | |
| 5,065,868 | A | | 11/1991 | Cornelissen et al. | |
| 5,076,439 | A | | 12/1991 | Kuchenbecker | |
| 5,077,064 | A | | 12/1991 | Hustad et al. | |
| 5,078,509 | A | | 1/1992 | Center et al. | |
| 5,082,702 | A | | 1/1992 | Alband | |
| 5,096,113 | A | | 3/1992 | Focke | |
| 5,103,980 | A | | 4/1992 | Kuchenbecker | |
| 5,124,388 | A | | 6/1992 | Pruett et al. | |
| 5,158,499 | A | | 10/1992 | Guckenberger | |
| 5,161,350 | A | | 11/1992 | Nakamura | |
| 5,167,974 | A | | 12/1992 | Grindrod et al. | |
| 5,174,659 | A | | 12/1992 | Laske | |
| 5,184,771 | A | | 2/1993 | Jud et al. | |
| 5,197,618 | A | * | 3/1993 | Goth | 215/232 |
| 5,222,422 | A | | 6/1993 | Benner, Jr. et al. | |
| 5,294,470 | A | | 3/1994 | Ewan | |
| 5,307,988 | A | | 5/1994 | Focke et al. | |
| 5,333,735 | A | | 8/1994 | Focke et al. | |
| 5,352,466 | A | | 10/1994 | Delonis | |
| 5,366,087 | A | | 11/1994 | Bane | |
| 5,375,698 | A | | 12/1994 | Ewart et al. | |
| 5,381,643 | A | | 1/1995 | Kazaitis et al. | |
| 5,382,190 | A | | 1/1995 | Graves | |
| 5,405,629 | A | | 4/1995 | Marnocha et al. | |
| 5,407,070 | A | | 4/1995 | Bascos et al. | |
| 5,409,116 | A | | 4/1995 | Aronsen | |
| 5,460,838 | A | | 10/1995 | Wermund | |
| 5,461,845 | A | | 10/1995 | Yeager | |
| 5,464,092 | A | | 11/1995 | Seeley | |
| 5,499,757 | A | | 3/1996 | Back | |
| 5,505,305 | A | | 4/1996 | Scholz et al. | |
| 5,519,982 | A | | 5/1996 | Herber et al. | |
| 5,520,939 | A | | 5/1996 | Wells | |
| 5,524,759 | A | | 6/1996 | Herzberg et al. | |
| 5,531,325 | A | | 7/1996 | Deflander et al. | |
| 5,538,129 | A | | 7/1996 | Chester et al. | |
| 5,582,853 | A | | 12/1996 | Marnocha et al. | |
| 5,582,887 | A | * | 12/1996 | Etheredge | 428/41.5 |
| 5,591,468 | A | | 1/1997 | Stockley, III et al. | |
| 5,633,058 | A | * | 5/1997 | Hoffer et al. | 428/40.1 |
| 5,637,369 | A | | 6/1997 | Stewart | |
| 5,647,100 | A | | 7/1997 | Porchia et al. | |
| 5,702,743 | A | | 12/1997 | Wells | |
| 5,770,283 | A | | 6/1998 | Gosselin et al. | |
| 5,795,604 | A | | 8/1998 | Wells et al. | |
| 5,833,368 | A | | 11/1998 | Kaufman | |
| 5,855,435 | A | | 1/1999 | Chiesa | |
| 5,862,101 | A | | 1/1999 | Haas et al. | |
| 5,873,483 | A | | 2/1999 | Gortz et al. | |
| 5,873,607 | A | | 2/1999 | Waggoner | |
| 5,882,116 | A | | 3/1999 | Backus | |
| 5,906,278 | A | | 5/1999 | Ponsi et al. | |
| 5,908,246 | A | | 6/1999 | Arimura et al. | |
| 5,928,749 | A | | 7/1999 | Forman | |
| 5,938,013 | A | | 8/1999 | Palumbo et al. | |
| 5,939,156 | A | | 8/1999 | Rossi et al. | |
| 5,996,797 | A | | 12/1999 | Flaig | |
| 5,997,177 | A | | 12/1999 | Kaufman | |
| 6,056,141 | A | | 5/2000 | Navarini et al. | |
| 6,060,095 | A | | 5/2000 | Scrimager | |
| 6,065,591 | A | | 5/2000 | Dill et al. | |
| 6,066,437 | A | | 5/2000 | Kosslinger | |
| 6,077,551 | A | | 6/2000 | Scrimager | |
| 6,125,614 | A | | 10/2000 | Jones et al. | |

| | | | |
|---|---|---|---|
| 6,126,317 | A | 10/2000 | Anderson et al. |
| 6,152,601 | A | 11/2000 | Johnson |
| 6,213,645 | B1 | 4/2001 | Beer |
| 6,296,884 | B1 | 10/2001 | Okerlund |
| 6,299,355 | B1 | 10/2001 | Schneck |
| 6,318,894 | B1 | 11/2001 | Derenthal |
| 6,364,113 | B1 | 4/2002 | Faasse, Jr. et al. |
| 6,365,255 | B1 | 4/2002 | Kittel et al. |
| 6,383,592 | B1 | 5/2002 | Lowry et al. |
| 6,428,867 | B1 | 8/2002 | Scott et al. |
| 6,450,685 | B1 | 9/2002 | Scott |
| 6,457,585 | B1 | 10/2002 | Huffer et al. |
| 6,461,043 | B1 | 10/2002 | Healy et al. |
| 6,471,817 | B1 | 10/2002 | Emmert |
| 6,482,867 | B1 | 11/2002 | Kimura et al. |
| 6,517,243 | B2 | 2/2003 | Huffer et al. |
| 6,539,691 | B2 | 4/2003 | Beer |
| 6,554,134 | B1 | 4/2003 | Guibert |
| 6,589,622 | B1 | 7/2003 | Scott |
| 6,592,260 | B1 | 7/2003 | Randall et al. |
| 6,594,872 | B2 | 7/2003 | Cisek |
| 6,691,886 | B1 | 2/2004 | Berndt et al. |
| 6,698,928 | B2 | 3/2004 | Miller |
| 6,726,054 | B2 | 4/2004 | Fagen et al. |
| 6,726,364 | B2 | 4/2004 | Perell et al. |
| 6,746,743 | B2 | 6/2004 | Knoerzer et al. |
| 6,767,604 | B2 | 7/2004 | Muir, Jr. et al. |
| 6,865,860 | B2 | 3/2005 | Arakawa et al. |
| 6,889,483 | B2 | 5/2005 | Compton et al. |
| 6,951,999 | B2 | 10/2005 | Monforton et al. |
| 6,983,875 | B2 | 1/2006 | Emmott |
| 7,007,423 | B2 | 3/2006 | Andersson et al. |
| 7,021,827 | B2 | 4/2006 | Compton et al. |
| 7,032,757 | B2 | 4/2006 | Richards et al. |
| 7,040,810 | B2 | 5/2006 | Steele |
| 7,165,888 | B2 | 1/2007 | Rodick |
| 7,172,779 | B2 | 2/2007 | Castellanos et al. |
| 7,261,468 | B2 | 8/2007 | Schneider et al. |
| 2001/0000480 | A1 | 4/2001 | Stagg et al. |
| 2002/0182359 | A1 | 12/2002 | Muir, Jr. et al. |
| 2003/0019780 | A1 | 1/2003 | Parodi et al. |
| 2003/0039412 | A1 | 2/2003 | Rodick |
| 2003/0118255 | A1 | 6/2003 | Miller |
| 2003/0183637 | A1 | 10/2003 | Zappa |
| 2003/0183643 | A1 | 10/2003 | Fagen et al. |
| 2003/0210838 | A1 | 11/2003 | Steele |
| 2003/0223656 | A1 | 12/2003 | Razeti et al. |
| 2004/0011677 | A1 | 1/2004 | Arakawa et al. |
| 2004/0062838 | A1 | 4/2004 | Castellanos et al. |
| 2004/0091184 | A1 | 5/2004 | Miller |
| 2004/0112010 | A1 | 6/2004 | Richards et al. |
| 2004/0150221 | A1 | 8/2004 | Brown |
| 2004/0175060 | A1 | 9/2004 | Woodham et al. |
| 2004/0180118 | A1 | 9/2004 | Renger et al. |
| 2005/0000965 | A1 | 1/2005 | Boardman |
| 2005/0223071 | A1 | 10/2005 | Machacek |
| 2006/0171611 | A1 | 8/2006 | Rapparini |

FOREIGN PATENT DOCUMENTS

| | | | |
|---|---|---|---|
| EP | 0661154 | A | 7/1995 |
| EP | 0667828 | | 8/1995 |
| EP | 0 796 208 | | 12/1995 |
| EP | 0744357 | | 11/1996 |
| EP | 0752375 | | 1/1997 |
| EP | 0758993 | | 2/1997 |
| EP | 0905048 | A | 3/1999 |
| EP | 1056066 | | 11/2000 |
| EP | 1086906 | | 3/2001 |
| EP | 1375380 | | 1/2004 |
| EP | 1382543 | | 1/2004 |
| EP | 1437311 | | 7/2004 |
| EP | 1449789 | | 8/2004 |
| EP | 1457424 | | 9/2004 |
| EP | 1608567 | | 12/2005 |
| FR | 2674509 | | 10/1992 |
| FR | 2766794 | | 2/1999 |
| GB | 2276095 | A | 9/1994 |
| JP | 6080405 | | 5/1985 |
| JP | 09150872 | | 6/1997 |
| JP | 09156677 | A | 6/1997 |
| JP | 10059441 | | 3/1998 |
| JP | 10129685 | | 5/1998 |
| JP | 11198977 | | 7/1999 |
| JP | 2000335542 | | 12/2000 |
| WO | 9532902 | | 12/1995 |
| WO | 9725200 | | 7/1997 |
| WO | 02/066341 | | 8/2002 |
| WO | 03/059776 | | 12/2002 |
| WO | 03/013976 | A1 | 2/2003 |

OTHER PUBLICATIONS

"New on the Shelf—Product Instructions and Packaging Trends", *Circle Reader Service Card No. 93*, Aug. 1998, Baking & Snack.

Photograph depicting, on the right, Oreo pakaging of the type that is prior art.

Giant Baby Wipes package, item No. 80203–91, resealable packing having die cut–out portions (tabs) which remain affixed to the top of the package after label is withdrawn from the top, whereby tamper evidence is indicated by a misalignment of the die cut–out portions with the holes formed in the label.

European Patent Office; Second Communication; EP04252257 dated Sep. 24, 2009; 4 pages.

European Patent Office; Third Communication; EP04252257 dated Nov. 8, 2010; 3 pages.

European Patent Office Search Report and Opinion; EP10181784 dated Mar. 9, 2011; 7 pages.

European Patent Office Search Report and Opinion; EP10181886 dated Apr. 5, 2011; 12 pages.

European Patent Office Partial Search Report; EP10181886 dated Dec. 14, 2010; 7 pages.

European Patent Office Search Report; EP04252257 dated Oct. 21, 2004; 5 pages.

European Patent Office; First Communication; EP04252257 dated Jan. 24, 2008; 5 pages.

European Patent Office Partial Search Report: EP04252257 dated Aug. 4, 2004; 5 pages.

Response to First Communication from the European Patent Office; EP04252257; dated Jun. 4, 2008; 19 pages.

Response to Second Communication from the European Patent Office; EP04252257; dated Mar. 26, 2010; 8 pages.

Response to Third Communication from the European Patent Office; EP04252257; dated Mar. 8, 2011; 6 pages.

Select portions of prosecution history of U.S. Appl. No. 11/029,651.

Select portions of prosecution history of U.S. Appl. No. 11/098,872.

Select portions of prosecution history of U.S. Appl. No. 12/556,292.

Select portions of prosecution history of U.S. Appl. No. 11/193,613.

Select portions of prosecution history of U.S. Appl. No. 10/897,712.

Select portions of prosecution history of U.S. Appl. No. 11/193,614.

* cited by examiner

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1-25 is confirmed.

New claims 26-67 are added and determined to be patentable.

*26. The polygonal shaped food container of claim 1 wherein the frame has an upper periphery and the top has a pair of facing perimeter portions adjacent the access opening, the pair of facing perimeter portions extending inward beyond at least a portion of the upper periphery portion to capture the frame in the wrapper against unintentional removal through the access opening.*

*27. The polygonal shaped food container of claim 26 wherein the facing perimeter portions extend to additional perimeter portions, the perimeter portions combined to surround the access opening, and the perimeter portions all extend inward beyond the upper periphery portion to capture the frame in the wrapper against unintentional removal through the access opening.*

*28. The polygonal shaped food container of claim 26 wherein the sealing layer is releasably sealed adhesively to the perimeter portions.*

*29. The polygonal shaped food container of claim 26 wherein the wrapper is unattached to the frame and defines an outer profile for the container extending at least in part outwardly from the frame.*

*30. The polygonal shaped food container of claim 29 wherein the outer profile of the container extends outward from the frame at an end of the container and the wrapper is sealed to itself at the end of the container.*

*31. The polygonal shaped food container of claim 26 wherein the starter portion is free from the remainder of the container such that it can be grasped simultaneously from above and below to open the container.*

*32. The polygonal shaped food container of claim 26 wherein the frame has at least one divider to separate discrete food articles.*

*33. The polygonal shaped food container of claim 26 wherein the discrete food articles are cookies susceptible to damage and the frame and the wrapper cooperate to protect the cookies from damage.*

*34. A polygonal shaped food container comprising:*

*a frame defining the polygonal shape of the container, the frame having a bottom, sides and an upper periphery portion, the frame containing a food product comprised of discrete food product articles;*

*an overwrap encasing the frame, the overwrap forming an overwrap top, overwrap bottom and overwrap sides of the container over the frame and defining the top, bottom and sides of the container, the overwrap top having at least a pair of facing overwrap perimeter portions inward of the periphery portion of the frame,*

*the overwrap top having a reclosable access opening defined at least in part by the perimeter portions, the opening sufficiently large to provide hand access to substantially all of the discrete food articles contained within the frame such that substantially any one of the discrete food articles can be accessed and removed individually through the reclosable access opening, the upper periphery portion of the frame supporting the overwrap perimeter portions so that the overwrap perimeter portions are in a plane generally parallel to the bottom of the frame, the overwrap perimeter portions capturing the frame in the encasing overwrap to guard against unintentional removal of the frame through the opening from the encasing overwrap; and*

*a sealing layer adhesively sealed to the overwrap top around the reclosable access opening, the sealing layer including a starter portion located near a side of the overwrap top which can be grasped by a user, the sealing layer being releasable when said starter portion is pulled in a direction away from the side to in turn pull and thereby release at least a portion of the sealing layer to provide the hand access to the reclosable access opening and reclosable against the overwrap top to seal the access opening when the sealing layer is moved back against the overwrap top.*

*35. The polygonal shaped food container of claim 34 wherein the facing perimeter portions extend to additional perimeter portions extending inward of the periphery portion of the frame, the facing perimeter portions and additional perimeter portions combined to surround the reclosable access opening, and the perimeter portions all extend inward beyond the periphery portion of the frame to capture the frame in the overwrap against unintentional removal through the reclosable access opening, the upper periphery portion of the frame supporting all of the overwrap perimeter portions so that the overwrap perimeter portions are in a plane generally parallel to the bottom of the frame after the reclosable access opening is opened to expose the food product articles.*

*36. The polygonal shaped food container of claim 35 wherein the frame has a plurality of dividers extending transversely across the frame.*

*37. The polygonal shaped food container of claim 36 wherein the discrete food articles are cookies susceptible to damage and the frame and the overwrap cooperate to protect the cookies from damage.*

*38. The polygonal shaped food container of claim 35 wherein the overwrap top comprises a flap having substantially the same dimensions as the reclosable access opening and affixed to the sealing layer.*

*39. The polygonal shaped food container of claim 35, wherein the sealing layer covers substantially the entire top.*

*40. The polygonal shaped food container of claim 34 wherein the overwrap perimeter portions each span from the upper periphery portion of the frame to an adjacent edge of the access opening.*

*41. The polygonal shaped food container of claim 35 wherein the facing perimeter portions and the addtional perimeter portions each span from the upper periphery portion of the frame to an adjacent edge of the access opening.*

*42. The polygonal shaped food container of claim 1 wherein the frame is the only support for elevating the wrapper at the top of the container.*

*43. The polygonal shaped food container of claim 42 wherein the frame has a bottom, sides and an upper periphery portion, and the wrapper at the top of the container is generally planar between the entirety of the upper periphery portion of the frame.*

*44. The polygonal shaped food container of claim 1 wherein:*

*the frame has a bottom, sides and an upper periphery portion;*

*the wrapper is unattached to the upper periphery portion of the frame and at the top of the container having at least a pair of facing perimeter portions each spanning inward from the periphery portion of the frame to an adjacent edge of the access opening, the upper periphery portion of the frame and an inward dimension of the facing perimeter portions of the wrapper cooperating to locate the facing perimeter portions to permit the sealing layer to be resealable to the facing perimeter portions of the wrapper when the sealing layer is moved back against the top.*

*45. The polygonal shaped food container of claim 13 wherein the frame has a bottom, sides and an upper periphery portion, the generally rectangular top being generally planar and spanning entirely between the upper periphery portion of the frame.*

*46. A polygonal shaped food container comprising:*

*a frame defining the polygonal shape of the container, said container having a top, a bottom and sides connecting the top and bottom, the frame containing a food product comprised of discrete food articles; a wrapper surrounding said frame, said wrapper forming the top sides and bottom of the container; said top having an access opening sufficiently large to provide hand access to substantially all of the discrete food articles contained within the frame, such that substantially any one of the discrete food articles can be accessed and removed individually through said access opening; and a sealing layer, adhesively sealed to said top around said opening, said sealing layer including a starter portion located near a side of the top which can be grasped by a user, said sealing layer being releasable when said starter portion is pulled in a direction away from said side to in turn pull and thereby release at least a portion of said sealing layer to provide the hand access to said top access opening and reclosable against said top to seal said opening when said sealing layer is moved back against the said top, wherein the access opening has a tapered end opposite the starter portion of the sealing layer.*

*47. The polygonal shaped food container of claim 47 wherein the tapered end of the access opening has a pair of segments that taper toward each other and away from the starter portion.*

*48. A polygonal shaped food container comprising:*

*a frame defining the polygonal shape of the container, said container having a top, a bottom and sides connecting the top and bottom, the frame containing a food product comprised of discrete food articles;*

*a wrapper surrounding said frame, said wrapper forming the top, sides and bottom of the container;*

*said top having a flap which can be pulled back to form an access opening sufficiently large to provide hand access to substantially all of the discrete food articles contained within the frame, such that substantially any one of the discrete food articles can be accessed and removed individually through said access opening; and*

*a sealing layer adhesively sealed to the flap with a first adhesive strength and adhesively sealed to said top around said opening with a second adhesive strength, the first adhesive strength being greater than the second adhesive strength, said sealing layer including a starter portion located near a side of the top which can be grasped by a user, said sealing layer being releasable when said starter portion is pulled in a direction away from said side to in turn pull and thereby release at least a portion of said sealing layer sealed to the top around said opening having the second adhesive strength to provide the hand access to said top access opening and reclosable against said top to seal said opening when said sealing layer is moved back against the said top.*

*49. The polygonal shaped food container of claim 48, wherein the flap remains attached to the sealing layer when the portion of the sealing layer is released to provide the hand access to the top access opening.*

*50. The polygonal shaped food container of claim 49, wherein the sealing layer is permanently sealed to the flap and the sealing layer is removably sealed to the top around the access opening.*

*51. A polygonal shaped food container comprising:*

*a frame defining the polygonal shape of the container, said container having a top, a bottom and sides connecting the top and bottom, the frame containing a food product comprised of discrete food articles; a wrapper surrounding said frame, said wrapper forming the top sides and bottom of the container; said top having an access opening sufficiently large to provide hand access to substantially all of the discrete food articles contained within the frame, such that substantially any one of the discrete food articles can be accessed and removed individually through said access opening; and a sealing layer, adhesively sealed to said top around said opening, said sealing layer including a starter portion located near a side of the top which can be grasped by a user, said sealing layer being releasable when said starter portion is pulled in a direction away from said side to in turn pull and thereby release at least a portion of said sealing layer to provide the hand access to said top access opening and reclosable against said top to seal said opening when said sealing layer is moved back against the said top, wherein the top has a flap which can be pulled back to form the access opening, the sealing layer has a first adhesive zone coextensive with the flap and adhered to the flap using a first adhesive strength and a second adhesive zone outward of the periphery of the flap and adhered to the top using a second adhesive strength, the first adhesive strength being greater than the second adhesive strength such that the portion of the sealing layer outward of the periphery of the flap can be released to provide the hand access to the top access opening with the flap remaining attached via the second adhesive zone to a portion of the sealing layer coextensive with the flap.*

*52. The polygonal shaped food container of claim 51, wherein the sealing layer is permanently sealed to the flap and the sealing layer is removably sealed to the top around the access opening.*

*53. The polygonal shaped food container of claim 48, wherein said starter portion comprises a tab which projects past an edge of said top at one side of the container, said tab being accessible beyond the edge to be grasped.*

*54. The polygonal shaped food container of claim 48, further comprising tamper-evident means.*

*55. The polygonal shaped food container of claim 48, wherein said starter portion comprises a tab.*

*56. The polygonal shaped food container of claim 48, wherein said sealing layer covers substantially the entire top.*

*57. The polygonal shaped food container of claim 48 wherein the frame has an upper periphery portion and the top has a pair of facing perimeter portions adjacent the access opening, the pair of facing perimeter portions extending inward beyond at least a portion of the upper periphery portion to capture the frame in the wrapper against unintentional removal through the access opening.*

*58. The polygonal shaped food container of claim 57 wherein the facing perimeter portions extend to additional perimeter portions, the perimeter portions combined to surround the access opening, and the perimeter portions all extend inward beyond the upper periphery portion to capture the frame in the wrapper against unintentional removal through the access opening.*

*59. The polygonal shaped food container of claim 57 wherein the sealing layer is releasably sealed adhesively to the perimeter portions.*

*60. The polygonal shaped food container of claim 57 wherein the wrapper is unattached to the frame and defines an outer profile for the container extending at least in part outwardly from the frame.*

*61. The polygonal shaped food container of claim 60 wherein the outer profile of the container extends outward from the frame at an end of the container and the wrapper is sealed to itself at the end of the container.*

*62. The polygonal shaped food container of claim 57 wherein the starter portion is free from the remainder of the container such that it can be grasped simultaneously from above and below to open the container.*

*63. The polygonal shaped food container of claim 57 wherein the frame has at least one divider to separate discrete food articles.*

*64. The polygonal shaped food container of claim 57 wherein the discrete food articles are cookies susceptible to damage and the frame and the wrapper cooperate to protect the cookies from damage.*

*65. The polygonal shaped food container of claim 48 wherein:*

*the frame has a bottom, sides and an upper periphery portion;*

*the wrapper is unattached to the upper periphery portion of the frame and at the top of the container having at least a pair of facing perimeter portions each spanning inward from the periphery portion of the frame to an adjacent edge of the access opening, the upper periphery portion of the frame and an inward dimension of the facing perimeter portions of the wrapper cooperating to locate the facing perimeter portions to permit the sealing layer to be resealable to the facing perimeter portions of the wrapper when the sealing layer is moved back against the top.*

*66. The polygonal shaped food container of claim 48 wherein the access opening has a tapered end opposite the starter portion of the sealing layer.*

*67. The polygonal shaped food container of claim 66 wherein the tapered end of the access opening has a pair of segments that taper toward each other and away from the starter portion.*

* * * * *